US007454027B2

(12) United States Patent
Sorensen

(10) Patent No.: US 7,454,027 B2
(45) Date of Patent: Nov. 18, 2008

(54) HEARING AID, HEADSET OR SIMILAR DEVICE FOR DELIVERING A SOUND SIGNAL AT THE VICINITY OF THE TYMPANIC MEMBRANE

(75) Inventor: Per Kokholm Sorensen, Hellerup (DK)

(73) Assignee: Oticon A/S, Smørum (DK)

( * ) Notice: Subject to any disclaimer, the term of this patent is extended or adjusted under 35 U.S.C. 154(b) by 369 days.

(21) Appl. No.: 10/491,501

(22) PCT Filed: Sep. 27, 2002

(86) PCT No.: PCT/DK02/00637

§ 371 (c)(1),
(2), (4) Date: Apr. 1, 2004

(87) PCT Pub. No.: WO03/032682

PCT Pub. Date: Apr. 17, 2003

(65) Prior Publication Data

US 2004/0247149 A1 Dec. 9, 2004

(30) Foreign Application Priority Data

Oct. 12, 2001 (DK) ..... 2001 01503

(51) Int. Cl.
*H04R 25/00* (2006.01)

(52) U.S. Cl. ..... 381/322; 429/157

(58) Field of Classification Search ..... 381/314–315, 381/322–324, 328, 330, 312; 181/130; 600/25; 455/575.2, 575.7; 174/350; 429/157–158, 429/96, 162

See application file for complete search history.

(56) References Cited

U.S. PATENT DOCUMENTS

| | | | | |
|---|---|---|---|---|
| 5,721,783 | A * | 2/1998 | Anderson | 381/328 |
| 5,825,896 | A | 10/1998 | Leedom | |
| 6,208,741 | B1 * | 3/2001 | Shennib et al. | 381/323 |
| 6,253,871 | B1 * | 7/2001 | Aceti | 181/135 |
| 6,359,993 | B2 | 3/2002 | Brimhall | |
| 6,473,513 | B1 * | 10/2002 | Shennib et al. | 381/328 |
| 6,641,952 | B2 * | 11/2003 | Maple | 429/157 |
| 6,940,988 | B1 * | 9/2005 | Shennib et al. | 381/322 |
| 7,010,137 | B1 * | 3/2006 | Leedom et al. | 381/328 |
| 2002/0012438 | A1 * | 1/2002 | Leysieffer et al. | 381/312 |

FOREIGN PATENT DOCUMENTS

| | | |
|---|---|---|
| WO | 9955131 | 11/1999 |
| WO | 0076271 | 12/2000 |
| WO | 0108444 | 2/2001 |

* cited by examiner

*Primary Examiner*—Vivian Chin
*Assistant Examiner*—Lun-See Lao
(74) *Attorney, Agent, or Firm*—Dykema Gossett PLLC

(57) ABSTRACT

A hearing aid or headset for delivering a sound signal to the vicinity of the tympanic membrane includes at least a signal capture device, a signal processing unit, a receiver and an energy storage unit for storage and supply of electric energy, the energy storage unit including two or more sections which are interconnected in a manner which allows angulation of one section with respect to the neighboring section/sections.

8 Claims, 3 Drawing Sheets

HEARING AID, HEADSET OR SIMILAR DEVICE FOR DELIVERING A SOUND SIGNAL AT THE VICINITY OF THE TYMPANIC MEMBRANE

BACKGROUND OF THE INVENTION

The present invention relates to hearing aids and head sets which deliver sound signals to the vicinity of the tympanic membrane. In recent years hearing aids and head sets have diminished considerably in size, and CIC style (completely in the channel) hearing aids have been sold as state of the art for a number of years and work is continuously going on to further diminish the size of these apparatuses.

In WO 99/55131 a CIC hearing aid is provided wherein the battery is shaped as a hollow cylindrical part and accommodated within the shell of the hearing aid. According to this document the cylindrical part encircles the active components of the hearing aid, namely tile microphone, the receiver and the amplifier. In order to do this the cylindrical part must have a certain length, and this may cause problems, especially in people who have ear canals with bends.

The object of the present invention is to provide a hearing aid or similar device, which is comfortable to wear, also for people whose ear canals are bent, and a device wherein further miniaturization is possible. Also it is becoming more and more common to include some sort of transmitter within hearing aids or head sets for transmitting either a wired signal or a wireless signal to some other communication device. This results in higher energy consumption and the demand for better energy storage means increases. The invention provides improved energy storage means along with better possibilities of miniaturization.

SUMMARY OF THE INVENTION

According to a first aspect of the invention a hearing aid, headset or similar device for delivering a sound signal to the vicinity of the tympanic membrane includes at least a signal capture device, a signal processing unit, a receiver and an energy storage unit, e.g., for storage and supply of electric energy, where the energy storage unit includes two or more sections which are interconnected in a manner which allows angulation of one section with respect to the neighboring section/sections. The capture device could be one or more microphones, a device for capturing a wireless signal or a socket for reception of a signal by wire. The receiver includes an electrical-to-sound converting element like a loudspeaker. By dividing the energy storage unit into a number of sections, it becomes possible to accommodate the battery unit in hearing aids which has different shapes. This is the case with CIC hearing aids, which are customized to the individual user. In other hearing aids it is advantageous to use batteries, which are sectionalized, such that optimal use may be made of the available space inside the hearing aid.

In an embodiment of the invention two neighboring sections of the energy storage unit are separated by a resilient part forming a link between the two sections. Through this the two battery sections are easily placed in angular relationship for mounting in a hearing aid.

The resilient part separating the battery sections could be realized by fastening the battery sections to a common sheet of flexible material. The sheet material would then constitute the resilient part, which provides the link. One way to accomplish this embodiment of the invention is to fasten the battery sections to a flexprint sheet.

Another way to accomplish this embodiment is to provide a separate material part, which is glued or in some other way fastened to a side of each of to consecutive battery sections. In either case the battery sections could be realized in any shape, like flat or cylindrical.

In a further aspect of the invention two neighboring sections of the energy storage unit are separated by a section comprising a flexible material, which may be hardened into a rigid state. In this way a predefined angular position between two battery sections may be maintained. This could be advantageous in CIC hearing aids, which are custom made, but where loose parts within the apparatus are not tolerated. In this case a given angular position between consecutive sections of batteries are initially chosen so as to make the battery fit within the apparatus, and then the chosen angular positions are maintained by hardening the flexible parts. The hardening could take place by itself over time, or could be accelerated by heat or light.

Advantageously at least one section of the energy storage units is curved. In this manner the curved section can be placed adjacent a curved internal wall of the hearing aid and in this manner optimal use of the space within the hearing aid is ensured. Preferably the curved section form at least a part of a cylindrical shape, whereby the electronic components of the hearing aid are surrounded by the cylindrical shape. This is an advantage especially for CIC instruments, as the ear canal at least at some points may be cylindrical or semi-cylindrical. Thereby a battery having a cylindrical shape makes good use of the available space within the canal.

Preferably an antenna for a wireless link is accommodated within the cylindrical body of the battery section. A directional antenna could be placed within the cylindrical body, and this could be an advantage in hearing aids with interaural radio communication. In a further preferred embodiment of the invention the energy storage unit is a rechargeable battery. Thereby the battery can stay in the hearing aid for a long period and the usual frequent and cumbersome process of changing batteries is avoided. Preferably the rechargeable battery is connectable to a coil located within the device, such that the battery may be recharged by placing the device in a changing magnetic field. Thereby no wired connection with an external device is required in order to recharge the battery. Such wireless recharge systems are well known in other areas, and their advantages in he hearing aid area are obvious.

DESCRIPTION OF A PREFERRED EMBODIMENT

Figure 1:
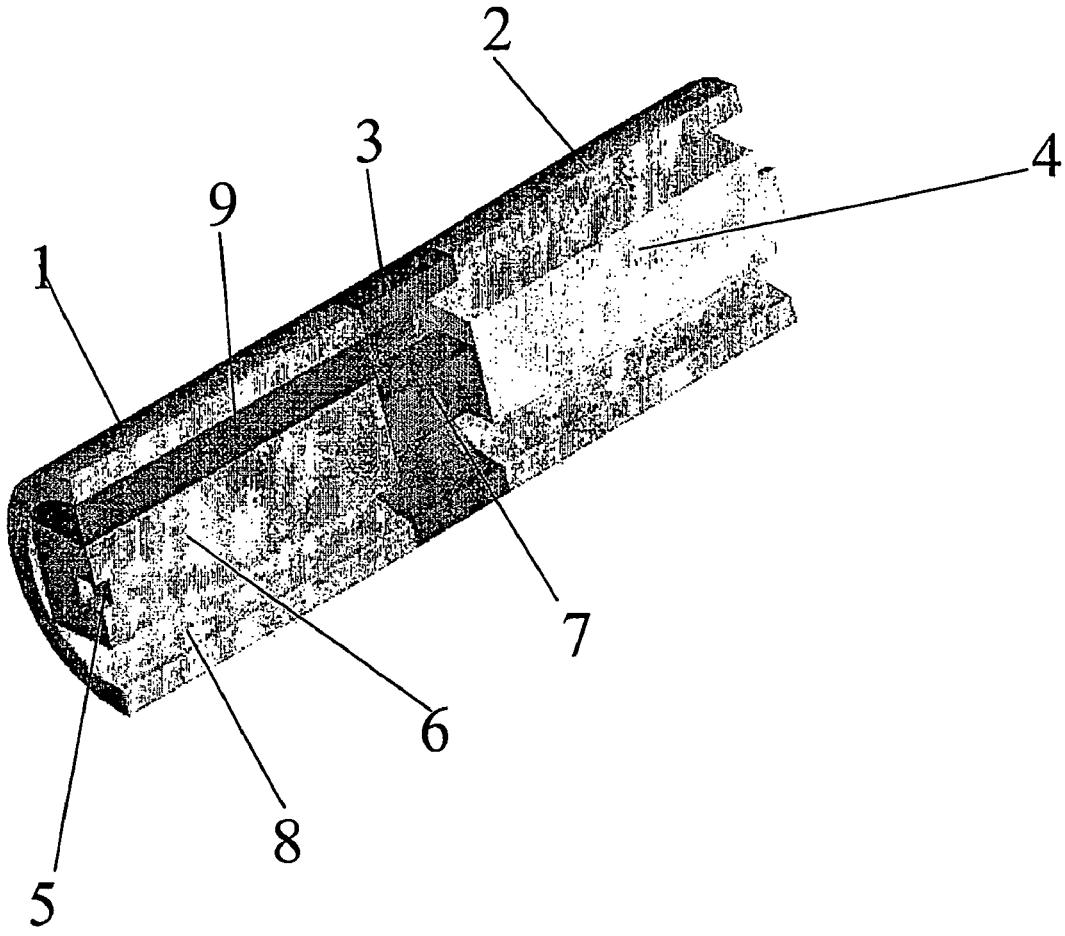
FIG. 1 shows a sectional view of a hearing aid according to the invention.

In FIG. 1 a hearing aid is shown which has a first battery section 1 and a second battery section 2, and an intermediate part 3. The battery sections 1,2 and the intermediate part 3 are all tubular and have the same diameter and thickness. The intermediate part 3 is made of a resilient material, and it allows the two battery sections to be angled with respect to each other. As seen from FIG. 1 the tubular battery is circular, but as is clear from the foregoing also oval or other non-circular shapes may be used. Also, the battery sections could be shapes as U- V- I- or other profiles.

The intermediate part 3 could be glued or fastened to the two battery sections 1,2 in some other fashion. Also it is possible to have the two battery sections placed inside a tubular foil, spaced some distance apart. By choosing a flexible foil the distance between the batteries 1,2 will function as the intermediate part 3. A heat shrinking foil tube could be used, or tape having an adhesive at one side may be wound around the battery sections 1,2 to form a tube which will at the same time accommodate the batteries and form the flexible intermediate part.

Inside the tubular battery sections the electronic parts of the hearing aid are placed. In FIG. 1 the receiver 4, the microphone 5 and the amplifier 6 are schematically shown. In the shown embodiment, the microphone 5 and the amplifier 6 are integrated in one and the same unit, but they could also be made as two separate units. Between the receiver and the amplifier a flexible block 7 is shown, which indicates a flexible signal transmitting medium. The hearing aid in FIG. 1 also has a vent 8 and an antenna 9. The antenna 9 could be a directional antenna to receive/transmit signals between the two hearing aids in a hearing impaired person's ears, or it could be used for picking up a relevant wireless signal in the surroundings.

Figure 2:
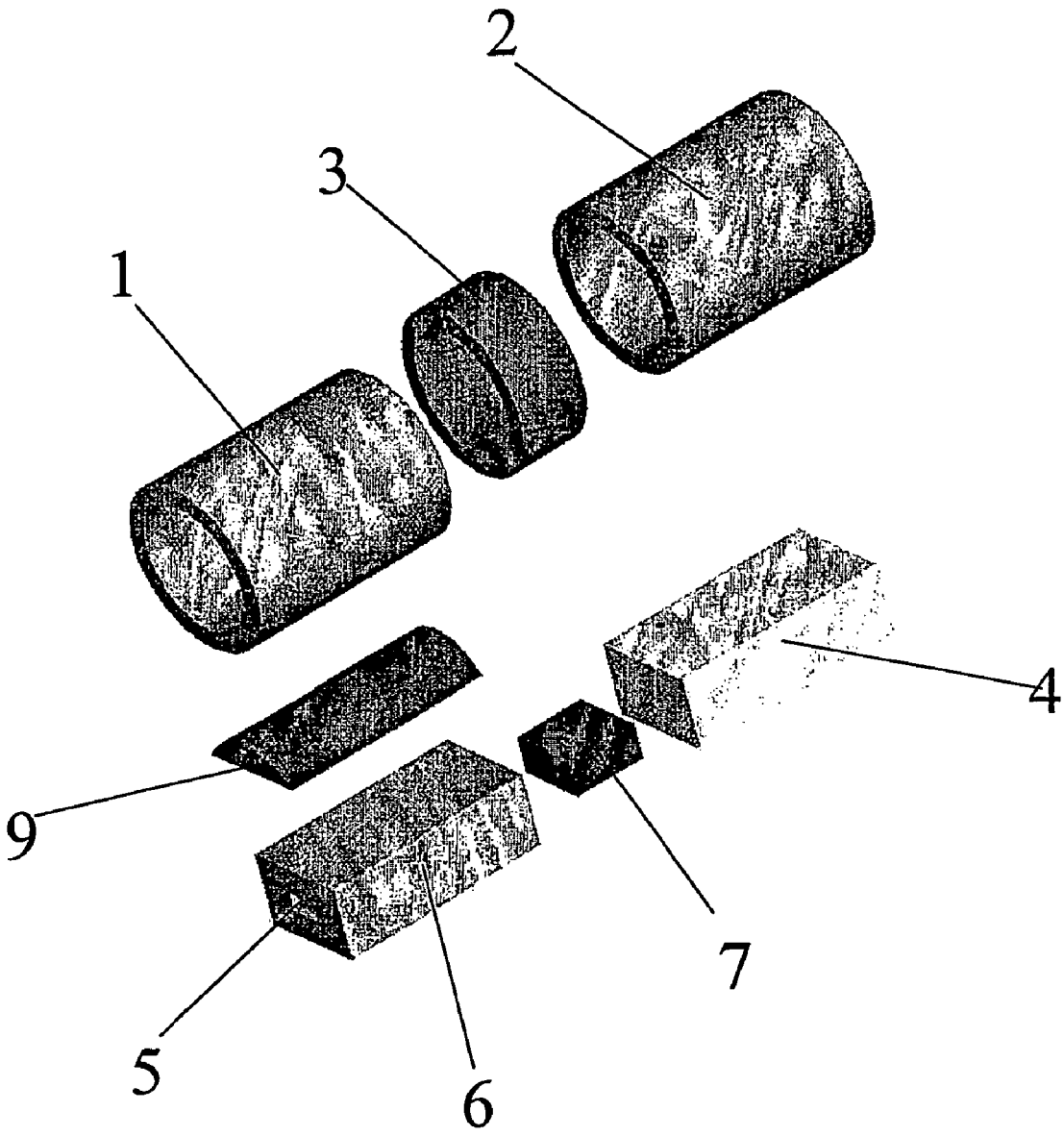
FIG. 2 shows an exploded view of a hearing aid according to an embodiment of the invention.
Figure 3:
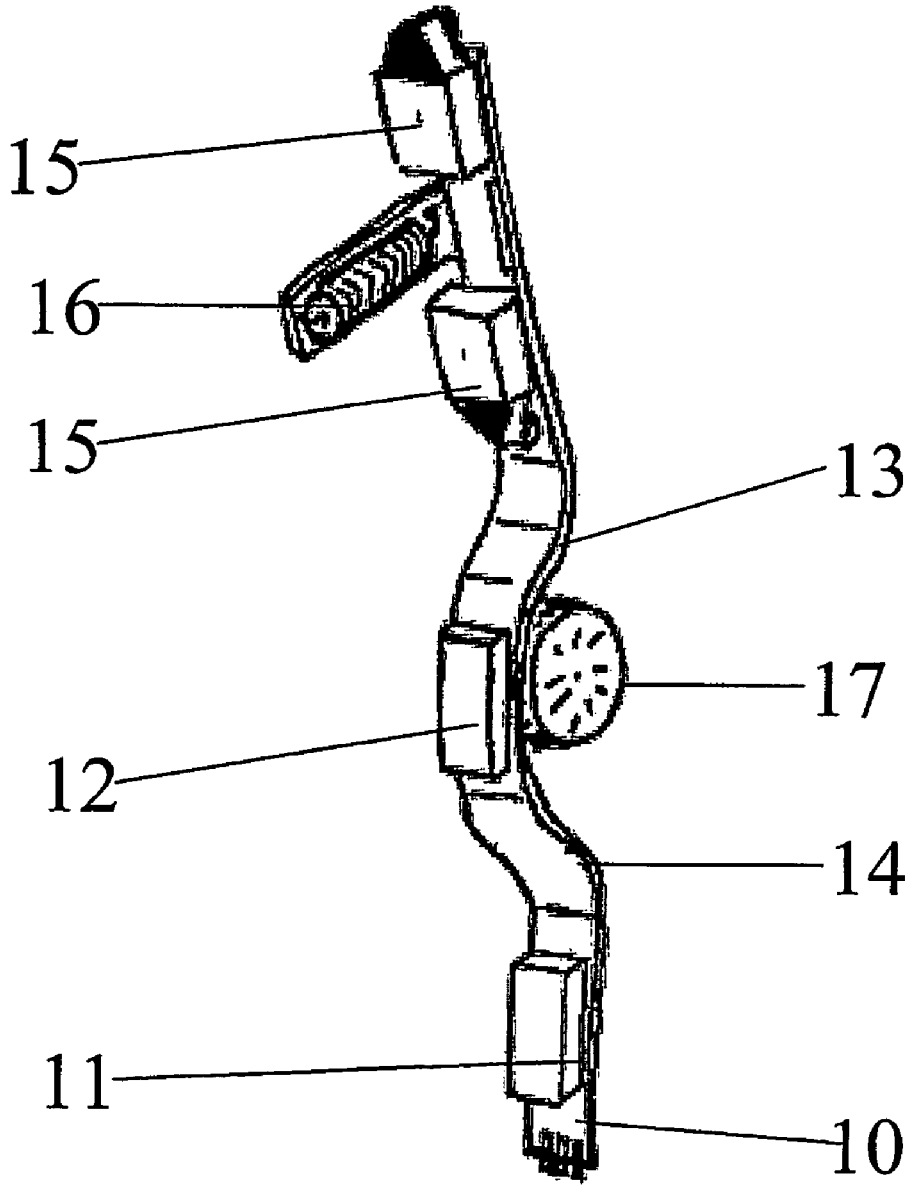
FIG. 3 is a perspective representation of a flexprint whereon the battery elements are mounted.

In the hearing aid according to FIGS. 1 and 2 the battery sections are made of tubular parts, but according to the inventions other shapes may be employed. Flat batteries is an obvious option. Such batteries may be fastened to a piece of flexible foil whereupon the foil can be folded along the sections between consecutive batteries. This is advantageous in BTE style hearing aids where more irregularly shaped spaces should be filled with battery material as far as possible. As seen in FIG. 3, a flexprint foil 10 is used for this purpose, and the foil carries the batteries 11,12 at one side and the electronic parts of the hearing aid spaced on other parts of the foil 10. In FIG. 3 the other electronic parts shown are: microphones 15, telecoil 16 and control wheel 17. When placed within the hearing aid shell the flexprint foil 10 is folded at a folding section 14 between consecutive batteries. Other folding sections 13 may be present at the foil.

The invention claimed is:

1. A hearing aid or headset for delivering a sound signal to the vicinity of the tympanic membrane, comprising a signal capture device, a signal processing unit, a receiver, and an energy storage unit for storage and supply of electric energy, said energy storage unit comprising first and second batteries and a resilient element interconnected between said first and second batteries, said resilient element enabling a change in angulation between said first and second batteries.

2. A hearing aid or head set as claimed in claim 1, wherein two neighboring sections of the energy storage unit are separated by a section comprising a flexible material, which may be hardened into a rigid state.

3. A hearing aid or head set as claimed in claim 1, wherein at least one section of the energy storage unit is curved.

4. A hearing aid or head set as claimed in claim 3, wherein the curved section forms at least a part of a cylindrical shape, whereby the signal capture device, the signal processing unit and the receiver are surrounded by the cylindrical shape of the battery section.

5. A hearing aid or head set as claimed in claim 4, including an antenna for a wireless link accommodated within the cylindrical shape of the battery section.

6. A hearing aid or head set as claimed in claim 1, wherein said first battery is a rechargeable battery.

7. A hearing aid or head set as claimed in claim 6, including a coil, and wherein the rechargeable battery is connectable to the coil such that the battery may be recharged by placement in a changing magnetic field.

8. A hearing aid or head set as claimed in claim 1, including a transmitter, and wherein the energy storage unit provides electric power to the transmitter.

* * * * *